US005853134A

United States Patent [19]

Kleppestø et al.

[11] Patent Number: 5,853,134

[45] Date of Patent: Dec. 29, 1998

[54] APPARATUS FOR STORING ROPES OR THE LIKE

[75] Inventors: Harald Kleppestø , Bryne; Øyvind Olsbu, Arendal; Erling Huse, Harøy; Erling Myklebust, Myklebust, all of Norway

[73] Assignee: Den Norske Stats Oljeselskap A.S., Stavanger, Norway

[21] Appl. No.: 793,106

[22] PCT Filed: Aug. 2, 1995

[86] PCT No.: PCT/NO95/00135

§ 371 Date: Apr. 15, 1997

§ 102(e) Date: Apr. 15, 1997

[87] PCT Pub. No.: WO96/06770

PCT Pub. Date: Mar. 7, 1996

[30] Foreign Application Priority Data

Aug. 26, 1994 [NO] Norway ..... 943155

[51] Int. Cl.[6] ..... B21C 47/00

[52] U.S. Cl. ..... 242/360; 242/361; 242/361.1; 242/363; 354/382

[58] Field of Search ..... 242/360, 361, 242/361.2, 362, 363, 361.1, 361.4; 254/382

[56] References Cited

U.S. PATENT DOCUMENTS

| | | | |
|---|---|---|---|
| 373,462 | 11/1887 | Lenox | 242/361 X |
| 2,929,575 | 3/1960 | Kovaleski | 242/82 |
| 3,168,259 | 2/1965 | Cady | 242/83 |
| 3,717,325 | 2/1973 | Peterson | 254/175.7 |
| 3,750,974 | 8/1973 | Dibrell | 242/360 X |
| 4,944,465 | 7/1990 | Levine | 242/360 |
| 5,575,455 | 11/1996 | Jenkins et al. | 242/361.4 X |

OTHER PUBLICATIONS

Derwent's Abstract, No. 90–153459/20, week 9020, Abstract of Soviet Union, 1518191, (Mikhailovskii B. P.), Oct. 30, 1989.

Derwent's Abstract, No. 87–184168/26, week 8726, Abstract of Soviet Union, 1270052 (Mikhailovski B. P.), Nov. 15, 1986.

Patent Abstracts of Japan, vol. 11, No. 215, M–606, abstract of Japan No. 62–31589, (Nippon Kokan K. K.), Feb. 10, 1987.

*Primary Examiner*—William Stryjewski

*Attorney, Agent, or Firm*—Foley & Lardner

[57] ABSTRACT

An assembly for storing a line in a coil in a storage room with a bottom and walls, as well as a central, upper opening to guide the line while it is being lead into or out of the storage room. The assembly comprising a central, round pole extending upward from the bottom of the room toward the central opening, and a guiding head mounted on top of the pole. The guiding head is shaped with such lateral dimensions in relation to the axis of the pole that the horizontal dimension is larger that the central opening. When the line is introduced to the storage room through the central opening, the line usually hits the head and is deflected so as to form the coil.

19 Claims, 1 Drawing Sheet

APPARATUS FOR STORING ROPES OR THE LIKE

BACKGROUND OF THE INVENTION

1. Field of the Invention

This invention relates to an arrangement for storing of a coiled line, especially anchor, mooring or buoy lines on board a ship.

2. Description of Related Art

On ships and other vessels at sea, or possibly on a quay or similar facilities on land, such lines are usually stored in reels. The reels are usually provided in relation to winches for hauling of the lines. When such a line is released, e.g. to drop an anchor, the storage reel is released to freely rotate while giving off the line. The line will then be released at first at a high velocity, but the velocity will decrease with the movement of the line, e.g. with an associated anchor, down through the water. In this kind of operations experience has shown that jamming of the line often occurs in the storage reel resulting in complications and extra work.

SUMMARY OF THE INVENTION

The present invention is related to an arrangement adapted to avoid the above mentioned problems, and also providing a rational, secure and easy handling of lines under conditions that often cause difficulties and strain in relation to the line as well as the equipment and personnel involved.

The lines mentioned here will usually mean ropes, such as mooring hawsers and ordinary ropes for anchors, buoys etc. used at sea. It may also mean hawsers and ropes of quite large dimensions, e.g. diameters of 12–15 cm. The length of the lines to be stored may be from a few tens of meters to a couple of thousand meters or more. In addition to the traditional ropes mentioned, which at the present may comprise synthetic fibers such as nylon etc, the above mentioned assembly may also be used in relation to ropes of steel or possibly chains, depending on the dimensions and bending properties of these types of lines.

What is novel and specific in the assembly according to the invention consists primarily in comprising a storage room with a bottom and walls as well as an upper central opening for guiding of the line as it is lead into or out of the storage room, a central, round pole extending from the bottom through the storage room towards the central opening, and a guiding head provided on top of the pole and shaped with such lateral dimensions in relation to the axis of the pole that the horizontal, lateral dimension of the head is larger than the central opening, such that the line when introduced into the storage room through the opening will usually hit the head and be deflected by this to form a coil being built up from the bottom of the storage room.

In a particularly preferred embodiment of the invention the guiding head is provided with means for rotation driven by a motor. The velocity of the rotation of the motor and the guiding head may advantageously be adjustable.

BRIEF DESCRIPTION OF THE DRAWINGS

The invention will described in detail referring to the enclosed drawings, in which.

DETAILED DESCRIPTION OF THE PREFERRED EMBODIMENTS

Figure 1:
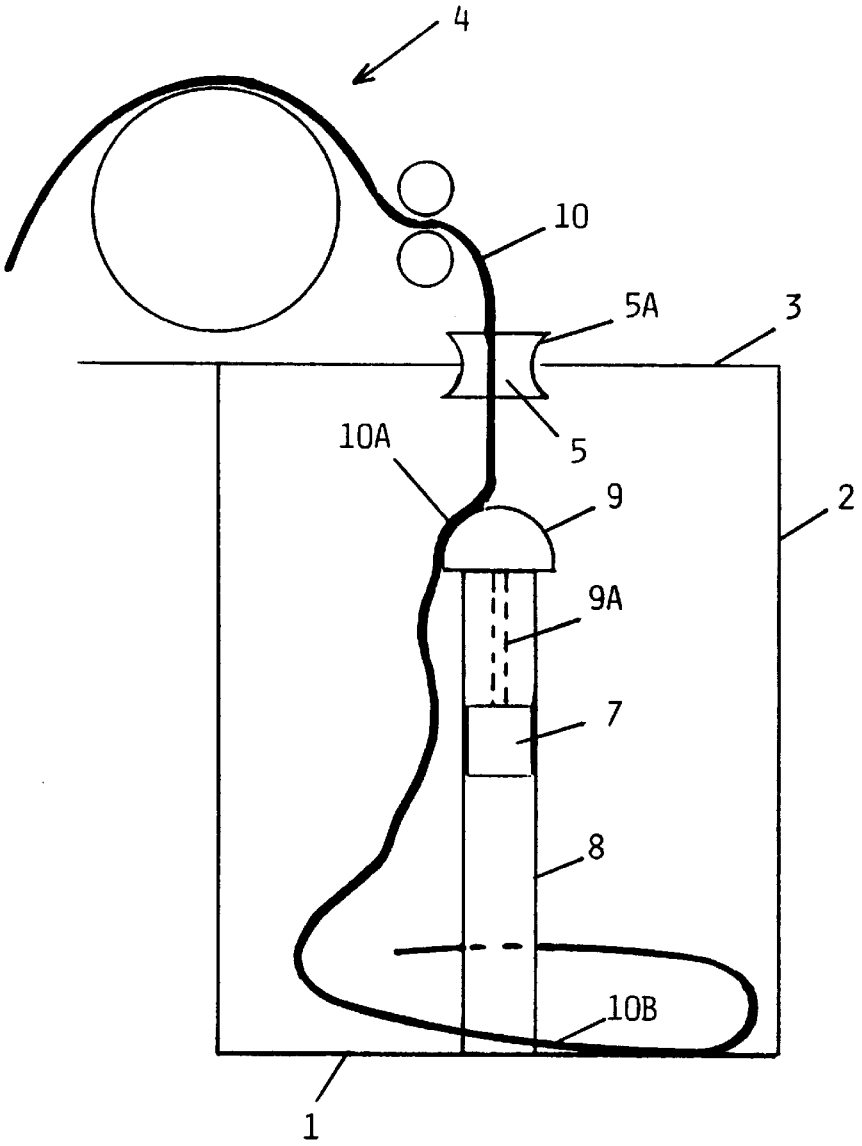
FIG. 1 illustrates a simplified vertical cross section of an embodiment of the assembly according to the invention.

In FIG. 1 there is shown a storage room 1 with walls 2 and a cover or a roof 3, where the basic shape of the storage room preferably may be circular. Other basic shapes may, however, also be used. Above the storage room 1, 2, 3 there is schematically illustrated a winch arrangement 4 which during operation will guide a line 10 into or out of, respectively, the storage room. This has thus a central opening 5 through which the line is lead. The opening 5 has an edge element 5A provided with a suitably rounded shape to ease the line movement through the opening, the edge element preferably being capable of guiding the line so as to have a central, axial movement through the opening 5.

From the bottom 1 of the storage room a round pole 8 is provided carrying a guiding head 9 with a well rounded shape as is illustrated in FIG. 1. The pole 8 is centrally positioned in the storage room and extends towards the central opening 5 such that the guiding head 9 is hit by the line 10 as the line is lead into the storage room. For this purpose the guiding head 9 has lateral dimensions (radially in relation to the axis of the pole 8) large enough to make it larger than the opening 5. Thus a line 10 being lead through the opening 5 will be diverted or deflected as illustrated at 10A and lead to position itself in a round coil around the pole 8. The coil will, as is illustrated at 10B, build itself up from the bottom 1 in the storage room, and form windings with larger or smaller circumference forming essentially horizontal layers in the storage room.

For obtaining a more efficient and secure deflection and coiling of the line during loading into the storage room there is, according to the invention, a great advantage if the guiding head 9 is capable of rotating, which in this embodiment is obtained by providing a motor 7 in the pole 8 with an axle 9A transferring the driving power to the head 9.

Figure 2:
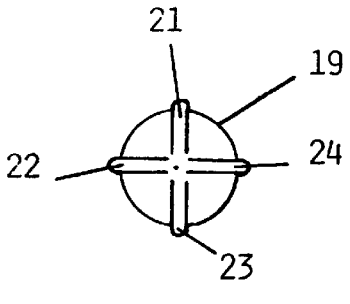
FIG. 2 illustrates a special embodiment of the guiding head, as seen from above.

To provide the guiding head 9 with gripping and driving capability on the corresponding part of the line 10A when being stored in the storing room, the head surface is preferably of a kind that gives good friction against the line. One way to obtain this is to provide the head 9 with a rubber coating. Another way is illustrated in FIG. 2, showing a head 19 as seen from above and provided with wing-shaped profiles consisting of profile elements 21, 22, 23, and 24 running from the top of the head 19 outward and axially downward. A possible rubber coating as described above may of course also be comprised in the embodiment of FIG. 2, as the wings 21–24 also may be rubber coated.

Of course many other kinds of surfaces and shapes may be contemplated regarding the guiding head 9 or 19, to obtain the desired entraining effect during the rotation of the top of the pole 8.

For the types of lines that have been of primary interest in relation to this invention, practice have shown it to be very suitable that the guiding head 9 as illustrated has a mainly rounded, upwards arched shape with an essentially flat lower side turned against the top of the pole 8.

It is pointed out above that it is advantageous that the guiding head is provided with means for rotation, these means being a motor 7. In special cases it may, however, be stationary, as already indicated in the introduction. In that case it is strongly preferred that the head surface has a low friction against the line. It may further be considered that a stationary head advantageously may have an upwardly pointed basic shape.

Regardless of the head being rotating or stationary and how its surface finish or shape may be, a preferred feature of the construction according to the invention is that the diameter of the pole 8 is less than the lateral dimension of the guiding head, such that only the surface of the guiding head 9 in the area by the top of the pole 8 gets in contact with the line 10 during its introduction to the storage room.

As for the relative basic dimensions of the storage room and the pole 8 with guiding head, as well as the position of the central opening 5 in the upper part of the storage room, it is clear that there is a large range of variations, depending primarily on the type and dimensions, hereunder especially the length, of the line 10 to be stored. In most applications it will, however, be an advantage if the central opening has a distance from the bottom 1 that is larger than the diameter of the storage room. Usually the preferred length of the pole 8 is between 50 and 80% of the height from the bottom of 1 to the opening 5.

In view of the above the function of the described assembly should be sufficiently clear, in that the line 10 when introduced and stored in the storage room will be coiled nicely around the pole 8 in smaller or larger coils without becoming disordered or jammed. When on the other hand the line 10 is taken out of the storage room, which often can happen at a high velocity, the line will run freely and undisturbed in such a way that the jamming and problems being present in previously known storage reels, are avoided.

We claim:

1. Assembly for storing of a line in a coil, comprising:

a storage room with a bottom as walls as well as a central, upper opening for guiding the line while it is led in or out of the storage room, a central, round pole extending from the bottom, through the storage room towards the central opening, and a guiding head being provided on top of the pole and shaped with such lateral dimensions in relation to the axis of the pole, that the horizontal extension of the head is larger than that of the central opening, the head being adapted to rotate, wherein the line, upon introduction into the storage room through the central opening and hitting the head, will be deflected by the head to form a coil being built up from the bottom of the storage room.

2. Assembly according to claim 1, characterized in that the guiding head is driven by a motor.

3. Assembly according to claim 2, characterized in that the guiding head has a treated surface for frictionally engaging the line.

4. Assembly according to claim 3, characterized in that the guiding head is treated with a rubber coating.

5. Assembly according to claim 2, characterized in that the guiding head is provided with an extended profile to enhance an entraining effect on the line.

6. Assembly according to claim 5, characterized in that the guiding head has a radially extended profile to enhance the entraining effect on the line.

7. Assembly according to claim 5, characterized in that the guiding head has an axially extended profile to enhance the entraining effect on the line.

8. Assembly according to claim 5, characterized in that the guiding head has a radially and axially extended profile to enhance the entraining effect on the line.

9. Assembly according to claim 2, characterized in that the motor is arranged in the pole.

10. Assembly according to claim 1, characterized in that the guiding head has an essentially rounded, upwards arched shape.

11. Assembly according to claim 10, characterized in that the guiding head has a substantially flat lower side facing the top of the pole.

12. Assembly according to claim 1, characterized in that the guiding head is fixed to the top of the pole and has surface adapted to provide low friction against the line.

13. Assembly according to claim 1, characterized in that the diameter of the pole is less than the lateral dimension of the guiding head.

14. Assembly according to claim 1, further comprising:

a rounded edge-element surrounding the central opening.

15. Assembly according to claim 14, characterized in that the rounded edge element is adapted to provide an axial guiding effect on, the line during the introduction into the storage room.

16. Assembly according to claim 1, characterized in that the storage room has a circular basic shape.

17. Assembly according to claim 16, characterized in that a distance from the central opening to the bottom is larger than the diameter of the storage room.

18. Assembly according to claim 1, characterized in that the height of the pole is between 50 and 80% of the distance from the bottom to the central opening.

19. Assembly according to claim 1, characterized in that the storage room is on board a ship for storing at least one of an anchor, mooring or buoy line.

* * * * *